US008392100B2

(12) United States Patent
Yamane et al.

(10) Patent No.: US 8,392,100 B2
(45) Date of Patent: Mar. 5, 2013

(54) METHOD AND APPARATUS FOR DETERMINING TRAFFIC DATA

(75) Inventors: Kenichiro Yamane, Paris (FR); Masatoshi Kumagai, Paris (FR)

(73) Assignee: Clarion Co., Ltd., Tokyo (JP)

( * ) Notice: Subject to any disclaimer, the term of this patent is extended or adjusted under 35 U.S.C. 154(b) by 578 days.

(21) Appl. No.: 12/536,978

(22) Filed: Aug. 6, 2009

(65) Prior Publication Data

US 2010/0036594 A1 Feb. 11, 2010

(30) Foreign Application Priority Data

Aug. 11, 2008 (EP) ..... 08014280

(51) Int. Cl.
*G08G 1/052* (2006.01)

(52) U.S. Cl. ..... 701/119

(58) Field of Classification Search ..... 701/201, 701/202, 204, 209, 1, 117–119, 400, 408, 701/409, 414, 415, 423, 465
See application file for complete search history.

(56) References Cited

U.S. PATENT DOCUMENTS

| | | | | |
|---|---|---|---|---|
| 5,173,691 | A * | 12/1992 | Sumner | 340/905 |
| 5,611,310 | A * | 3/1997 | Kuroda et al. | 123/399 |
| 5,787,383 | A * | 7/1998 | Moroto et al. | 701/418 |
| 6,256,579 | B1 * | 7/2001 | Tanimoto | 701/533 |
| 6,480,783 | B1 * | 11/2002 | Myr | 701/117 |
| 7,376,509 | B2 * | 5/2008 | Endo et al. | 701/423 |
| 7,463,973 | B2 * | 12/2008 | Okude et al. | 701/423 |
| 7,493,209 | B1 * | 2/2009 | Altrichter et al. | 701/423 |
| 7,508,321 | B2 * | 3/2009 | Gueziec et al. | 340/905 |
| 7,609,176 | B2 * | 10/2009 | Yamane et al. | 340/994 |
| 8,290,699 | B2 * | 10/2012 | Horiguchi et al. | 701/409 |
| 2001/0029425 | A1 * | 10/2001 | Myr | 701/200 |
| 2001/0044678 | A1 * | 11/2001 | Ito et al. | 701/1 |
| 2003/0069683 | A1 * | 4/2003 | Lapidot et al. | 701/117 |
| 2004/0249568 | A1 * | 12/2004 | Endo et al. | 701/209 |
| 2005/0080558 | A1 * | 4/2005 | Kasai | 701/209 |
| 2005/0206534 | A1 * | 9/2005 | Yamane et al. | 340/994 |
| 2006/0064233 | A1 * | 3/2006 | Adachi et al. | 701/117 |
| 2006/0161334 | A1 * | 7/2006 | Teramae | 701/117 |
| 2006/0178807 | A1 * | 8/2006 | Kato et al. | 701/117 |
| 2006/0227047 | A1 * | 10/2006 | Rosenberg | 342/357.13 |
| 2006/0287818 | A1 * | 12/2006 | Okude et al. | 701/209 |
| 2007/0005230 | A1 * | 1/2007 | Sera | 701/117 |
| 2007/0185643 | A1 * | 8/2007 | Yamane et al. | 701/117 |
| 2007/0208497 | A1 * | 9/2007 | Downs et al. | 701/117 |
| 2007/0208498 | A1 * | 9/2007 | Barker et al. | 701/117 |
| 2008/0071465 | A1 * | 3/2008 | Chapman et al. | 701/117 |
| 2008/0094250 | A1 * | 4/2008 | Myr | 340/909 |
| 2008/0114529 | A1 * | 5/2008 | Hiruta et al. | 701/117 |
| 2008/0234927 | A1 * | 9/2008 | O'Neill | 701/204 |

(Continued)

FOREIGN PATENT DOCUMENTS

JP 2003-279369 A 10/2003

OTHER PUBLICATIONS

European Search Report dated Jan. 19, 2009 (One (1) page).

*Primary Examiner* — Thomas Black
*Assistant Examiner* — Ce Li
(74) *Attorney, Agent, or Firm* — Crowell & Moring LLP

(57) ABSTRACT

The present invention relates to a method and apparatus for determining traffic data. The method comprises the steps of providing statistical data relating to traffic at links of a street map, providing condition data relating to links of the street map, and determining traffic data based on the statistical data and the condition data.

8 Claims, 8 Drawing Sheets

U.S. PATENT DOCUMENTS

2009/0041304 A1* 2/2009 Bradai et al. ..... 382/104
2009/0043486 A1* 2/2009 Yang et al. ..... 701/117
2009/0082952 A1* 3/2009 Narita et al. ..... 701/202
2009/0088963 A1* 4/2009 Horiguchi et al. ..... 701/200

* cited by examiner

FIG. 3

| # of Day-type n | | | |
|---|---|---|---|
| Day-type 1 (e.g. weekday-1) | # of time slots m1 | | |
| | Time slot 1 (e.g. 0:00-0:04) | # of links k1 | |
| | | Link-ID 1 | Travel time 1 (e.g. 86 sec) |
| | | | Stdev of Travel time 1 (e.g. 25 sec) |
| | | ⋮ | ⋮ |
| | | Link-ID k1 | Travel time k |
| | | | Stdev of Travel time k |
| | ⋮ | ⋮ | ⋮ |
| | Time slot m1 (e.g. 23:55-23:59) | # of links km | |
| | | Link-ID 1 | Travel time 1 |
| | | | Stdev of Travel time 1 |
| | | ⋮ | ⋮ |
| | | Link-ID km | Travel time k |
| | | | Stdev of Travel time k |
| ⋮ | | | |
| Day-type n (e.g. holiday-2) | # of time slots mn | | |
| | Time slot 1 (e.g. 0:00-0:04) | # of links k1 | |
| | | Link-ID 1 | Travel time 1 |
| | | | Stdev of Travel time 1 |
| | | ⋮ | ⋮ |
| | | Link-ID k1 | Travel time k |
| | | | Stdev of Travel time k |
| | ⋮ | ⋮ | ⋮ |
| | Time slot mn (e.g. 23:55-23:59) | # of links km | |
| | | Link-ID 1 | Travel time 1 |
| | | | Stdev of Travel time 1 |
| | | ⋮ | ⋮ |
| | | Link-ID km | Travel time k |
| | | | Stdev of Travel time k |

| Combination No. | Weather conditions | Road surface | Visibility | δ |
|---|---|---|---|---|
| 1 | Sunny or Cloudy | Dry | Good | 1.00 |
| 2 | Rainy | Wet | Good | 0.90 |
| ⋮ | ⋮ | ⋮ | ⋮ | ⋮ |

| | 1000 Ratio Rc = # of closed lanes / # of lanes | 1010 Closing level | 1020 ε |
|---|---|---|---|
| 1030 | Rc = 0.0 (no impact) | 0 | 1.0 |
| 1040 | 0.0 < Rc < 0.34 (low closing level, small impact) | 1 | 0.75 |
| 1050 | 0.34 <= Rc < 0.67 (medium closing level, medium impact) | 2 | 0.5 |
| 1060 | 0.67 <= Rc < 1.0 (high closing level, big impact) | 3 | 0.25 |
| 1070 | Rc = 1.0 (completely closed) | 4 | 0.0 |

METHOD AND APPARATUS FOR DETERMINING TRAFFIC DATA

CLAIM OF PRIORITY

The present application claims priority from European patent application serial no. 08014280.5 filed on Aug. 11, 2008, the contents of which are hereby incorporated by reference into this application.

FIELD OF THE INVENTION

The present invention relates to a method and an apparatus for determining traffic data.

BACKGROUND OF THE INVENTION

The method and the apparatus for determining traffic data are known for example from JP 2003-279369. In this document the time of arrival of a vehicle is estimated based on statistical traffic information that includes average travel speeds of links according to the day of the week and to the time of the day.

SUMMARY OF THE INVENTION

Based on the prior art, it is an object of the present invention to provide a method and an apparatus that is able to determine more accurate traffic data.

This object is accomplished by the independent claims 1 and 12. Preferred embodiments are specified by the dependent claims.

The invention comprises a method for determining traffic data comprising the steps of providing statistical data relating to traffic at links of a street map, providing condition data relating to links of the street map and determining traffic data based on the statistical data and the condition data.

These steps allow determining traffic data based on condition data. Since the condition data are more current than the statistical data, a more accurate prediction of, for example, a travel time can be achieved.

In the sense of the patent application, a link is for example a road section.

In some embodiments the condition data comprise speed trap data and/or weather data. The condition data may also comprise road works data.

The condition data may be retrieved from a server. In this way up-to-date condition data may be retrieved.

In some embodiments, the step of determining traffic data comprises the step of determining whether a modification of the statistical data is required based on the statistical data and the condition data.

This step allows to judge whether a modification of the statistical data is needed in view of the condition data. In this way, when the condition data is less relevant, the effort to modify the statistical data may be avoided.

In some embodiments, the step of determining traffic data may comprise the steps of determining links for which condition data is available, determining for each of said links a modification coefficient for modifying the statistical data, and determining traffic data based on the statistical data and the modification coefficients.

The modification coefficients allow for an easy modification of statistical data to determine the traffic data.

Preferably, the step of determining for each of said links a modification coefficient for modifying the statistical data comprises the steps of determining link condition data based on a link and the condition data, determining statistical link data based on the statistical data and said link, and determining a modification coefficient for modifying said statistical link data based on said link condition data.

These steps allow determining a modification coefficient link by link and to use the modification coefficients to efficiently determine traffic data.

Furthermore, the invention comprises a method for travel time prediction comprising the steps of the method for determining traffic data according to the invention as well as the steps of providing a travel start point and a travel end point, and predicting a travel time for travelling from the travel start point to the travel end point based on the determined traffic data.

This method allows to predict a travel time based on more accurate traffic data.

This method may further comprise the step of calculating an estimated time of arrival based on a current time and the predicted travel time.

In this way, furthermore an estimated time of arrival may be displayed to the driver of a vehicle.

In addition, the invention comprises a method for travel route recommendation comprising the steps of the method for travel time prediction according to the invention as well as the steps of predicting travel times for a plurality of routes for travelling from the travel start point to the travel end point based on the determined traffic data, determining the route of the plurality of routes having the shortest predicted travel time, and recommending the route with the shortest predicted travel time to a user.

In this way, up-to-date traffic data is used to recommend the fastest travel route to the user.

Furthermore, the invention comprises an apparatus for determining traffic data comprising means for providing statistical data relating to traffic at links of a street map, means for providing condition data relating to links of the street map and means for determining traffic data based on the statistical data and the condition data.

This apparatus may have the same advantages as the above described method for determining traffic data.

In some embodiments, the means for providing condition data is adapted to provide condition data comprising speed trap data and/or weather data. The means for providing condition data may be adapted to provide condition data comprising road works data.

In some embodiments, the apparatus comprises means for retrieving the condition data from a server.

The means for determining traffic data may comprise means for determining whether a modification of the statistical data is required based on the statistical data and the condition data.

Furthermore, in some embodiments, the means for determining traffic data may comprise means for determining links for which condition data is available, means for determining for each of said links a modification coefficient for modifying the statistical data, and means for determining traffic data based on the statistical data and the modification coefficients.

The means for determining for each of said links a modification coefficient for modifying the statistical data may comprise means for determining link condition data based on a link and the condition data, means for determining statistical link data based on the statistical data and said link, and means for determining a modification coefficient for modifying said statistical link data based on said link condition data.

In addition, the invention comprises an apparatus for travel time prediction comprising the means of the apparatus for determining traffic data according to the invention and further comprising means for providing a travel start point and a travel end point, and means for predicting a travel time for travelling from the travel start point to the travel end point based on the determined traffic data.

This apparatus may further comprise means for calculating an estimated time of arrival based on a current time and the predicted travel time.

Moreover, the invention comprises an apparatus for travel route recommendation comprising the means of the apparatus for travel time prediction according to the invention and further comprising means for predicting travel times for a plurality of routes for travelling from the travel start point to the travel end point based on the determined traffic data, means for determining the route of the plurality of routes having the shortest predicted travel time, and means for recommending the route with the shortest predicted travel time to a user.

The method and the apparatus may be implemented with the help of a computer program. Therefore, the invention furthermore comprises a computer program product, the computer program product comprising a computer readable medium and a computer program recorded therein in form of a series of state elements corresponding to instructions which are adapted to be processed by a data processing means of a data processing apparatus such that a method according to the invention is performed or an apparatus according to the invention is formed on the data processing means.

Preferred embodiments and further details of the invention will be explained with reference to the figures.

BRIEF DESCRIPTION OF THE DRAWINGS

FIG. 3 shows an embodiment of statistical data according to the invention.

DETAILED DESCRIPTION OF PREFERRED EMBODIMENTS

Figure 1:
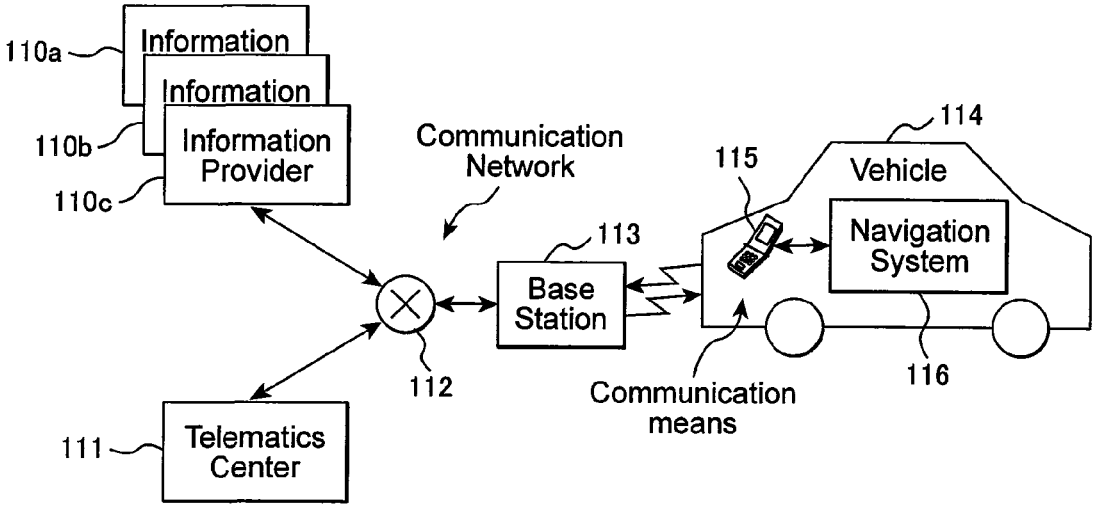
FIG. 1 shows a system architecture, in which the method and the apparatus according to the invention may be embedded.

FIG. 1 shows a block diagram of a traffic information system in which the method and the apparatus for determining traffic data according to the invention may be used. Information providers 110*a*-110*c* provide a telematics center 111 with data such as traffic information, weather information, map data, speed trap data, real-time incidents (e. g. traffic accidents, road works, etc.) and so on. The telematics center 111 receives the information from the information providers 110*a*-110*c* via the communication network 112. The communication network 112 may be a network for data communication such as the Internet, a mobile communication network, a dedicated communication line, etc.

A vehicle 114 is equipped with a navigation system 116 and a communication means 115. The communication means 115 may be a terminal for data communication such as a mobile phone, a wireless LAN terminal, a receiver for receiving a broadcast signal from a terrestrial station or a satellite etc. Via the communication means 115 and the base station 113 the navigation system 116 may retrieve data from the telematics center 111. The base station 113 is an access point to the communication network 112 such as a base station of a mobile communication network, an access point of a wireless LAN, etc.

Figure 2:
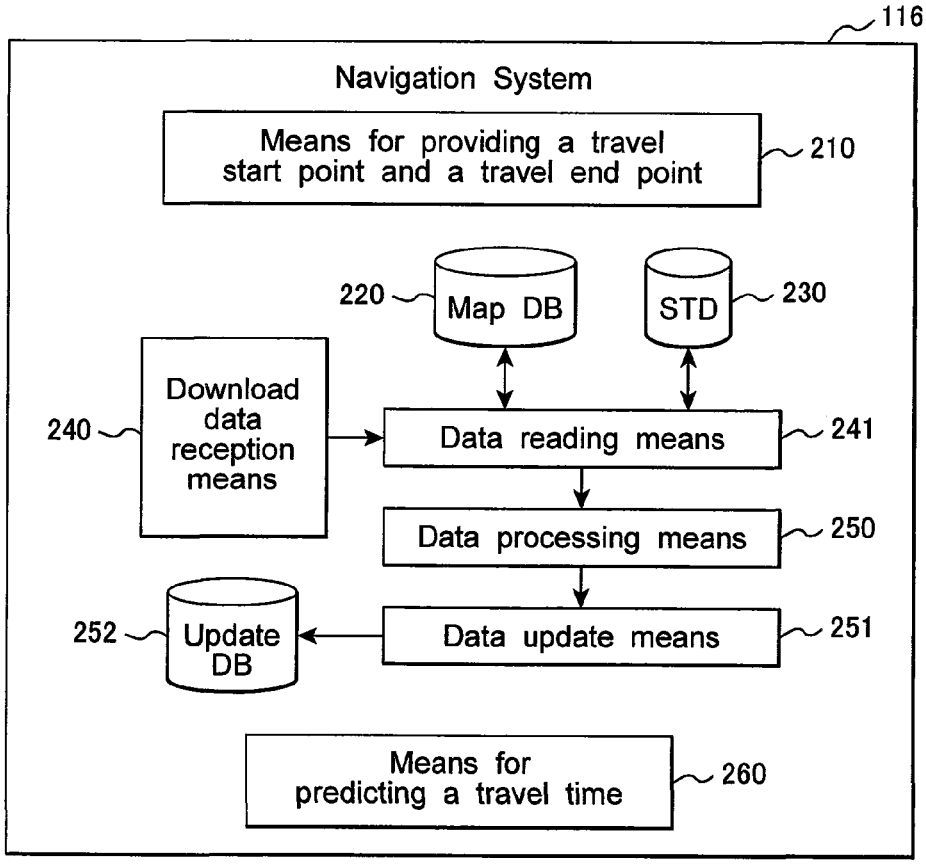
FIG. 2 shows a navigation system that comprises an embodiment of an apparatus according to the invention.

FIG. 2 shows an embodiment of a navigation system comprising an embodiment of an apparatus for travel time prediction according to the invention. The navigation system 116 comprises means for providing a travel start point and a travel end point 210 and a map database 220. The map database 220 includes link and node data corresponding to a street map. For example, link data includes a link-ID, a node-ID of both end points of the link, a length of the link (distance), a speed limit, the road type (motor way, ordinary road, etc.) and so on. Node data may include the node-ID, coordinates (longitude and latitude), node type (traffic lights, junction, entrance/exit of motorway, etc.), and so on.

The navigation system 116 furthermore comprises a database for statistical data (STD) 230. The statistical data may include a travel time (or a travel speed) on each link that is mentioned in the map database 220. It may furthermore include standard deviations for the respective travel times. The link travel times and also other data included in the statistical data may vary dependent on the day-types. For example, Mondays through Thursdays may be day-type 1, Friday may be day-type 2, Saturdays may be day-type 3, and Sundays may be day-type 4. The navigation system 116 may also comprise a calendar which defines day-types for each day so that it can easily find the correct day-type for each day.

FIG. 3 illustrates an embodiment of statistical data. The statistical data shown in FIG. 3 includes link travel times (or link travel speeds) for all day-types, which may be used for road search and for estimated time of arrival calculations in the navigation system.

The navigation system 116 shown in FIG. 2 furthermore comprises a download data reception means 240 that downloads data for example from the telematics center 111. The downloaded data may comprise for example traffic information, weather information, map data, speed trap data, real-time incidents (e. g. traffic accidents, road works, etc.) and so on. The downloaded data is read by a data reading means 241 which reads the data received by the download data reception means 240, the data of the map data database 220, the data of the statistical data database 230 and of an update database 252. The data reading means 241 stores the read data in the memory of the navigation system 116.

The navigation system 116 furthermore comprises a data processing means 250 that generates update data using the data read by the data reading means 241. Based on the generated data a data update means updates the update database 252.

Based on the data stored in the map database 220, in the statistical data database 230, and the update database 252 a means for predicting a travel time 260 may calculate the travel time for travelling from the travel start point to the travel end point.

Figure 4:
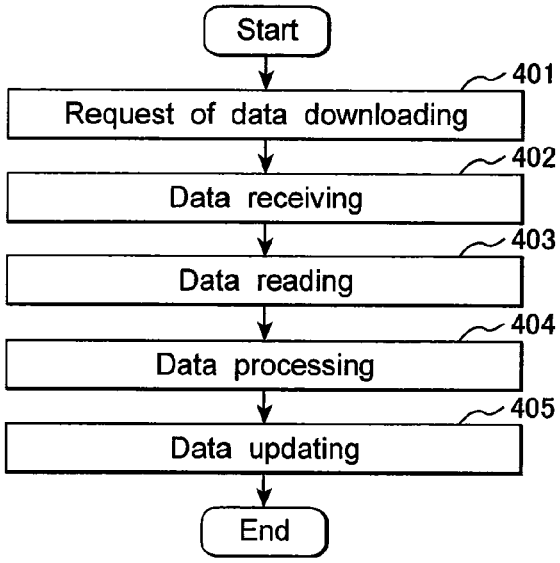
FIG. 4 shows an embodiment of a method for determining traffic data according to the invention.

FIG. 4 illustrates an embodiment of the method for determining traffic data based on the statistical data and the condition data. In step 401 the downloading of condition data is requested, which is received in step 402. Alternatively, data may be received from a broadcast sender like a terrestrial station or a satellite without any prior download request. The received condition data is read in step 403 and processed in step 404 together with statistical data and map data provided by the statistical data database 230 and the map database 220, respectively. As a result traffic data is determined based on the statistical traffic data and the condition data which is stored in step 405 in the update database 252.

The update database 252 includes the parts of the map database 220 and the statistical data database 230, which have been modified by the data processing means 250. Before the navigation system 116 calculates routes or estimated time of arrivals, it reads the map database 220, the statistical data database 230, and the update database 252. In order to improve the processing speed of the navigation system 116, instead of keeping the update database 252, the map database 220 and the statistical data database 230 may be updated directly or may be updated based on an intermediary file update database, such that the intermediary file update database may be removed after the update.

Figure 5:
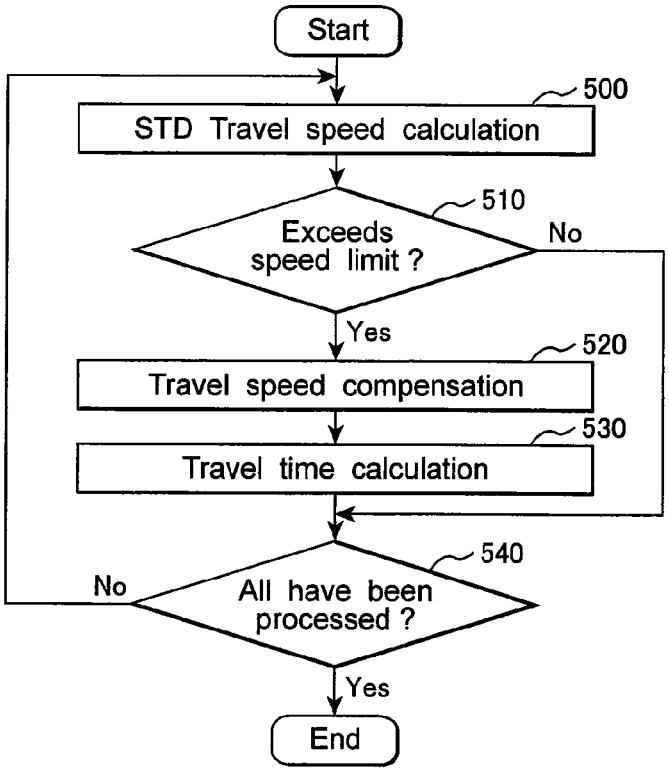
FIG. 5 shows aspects of an embodiment of the method according to the invention.

In the following, various embodiments of the method for determining traffic data based on the statistical data and the condition data will be explained with reference to the FIGS. 5-10. FIG. 5 illustrates one embodiment of the method for determining traffic data that uses speed trap data. Speed trap data may consist of the coordinates (or link-ID and the detailed position of the speed trap on the link) and the speed limit of the corresponding speed trap. Furthermore, the speed trap data may comprise data about the validity period of the speed limit that is enforced by the speed trap which may consist, for example, of a beginning date and time as well as an ending date and time. After the expiration of the ending date and time the corresponding speed trap data may be removed from the update database 252. Firstly, based on the link-ID of the link, on which the speed trap is installed, the travel time on the link is extracted from the statistical data database 230. From the link travel time of the statistical data and the lengths of the link, the link travel speed is calculated in step 500.

In step 510, the travel speed determined from the statistical data is compared with the speed limit of the speed trap. If the travel speed does not exceed the speed limit, the process continuous at step 540. Otherwise, the link travel speed of the statistical data is compensated in step 520. One approach to modify the travel speed is to use the formula $$V_m = \alpha \cdot V_f,$$

wherein $V_m$ denotes the modified speed, $V_f$ denotes the travel speed according to the statistical data, and a denotes a modification coefficient. The modification coefficient $\alpha$ is predetermined and may have the value 0.9 in the case of a speed trap, because normally many drivers slow down to a speed that lies a little bit under the speed limit around a speed trap.

Another approach is to modify the travel speed in accordance with a length of the link. In order to take into account that the section influenced by the speed trap is limited, the travel speed may be modified according to the following equation $$V_m = \frac{\beta \cdot L_i \cdot V_l + \gamma \cdot (L - L_i) \cdot V_f}{L},$$

wherein $L_i$ denotes the length of the link influenced by the speed trap, $V_l$ denotes the speed limit, L denotes the length of the entire link, $\beta$ denotes the modification coefficient for the speed limit, and $\gamma$ denotes a coefficient for a traffic situation in which the traffic is freely flowing. The modification coefficient $\beta$ is predetermined and may be for example 0.9, because normally drivers slow down to a speed that lies under the actual speed limit of the speed trap. The coefficient $\gamma$ is also predetermined and may be for example 1.1, because many drivers tend to drive faster than the actual speed limit of a section allows, when no speed trap is present.

In step 530, the travel time on the link is calculated based on the compensated travel speed $V_m$ and the length of the link.

Afterwards, it is checked in step 540 whether all the links of the downloaded speed trap data have been processed. If not all of them have been processed yet, the system goes back to step 500, such that the process is iterated until all the links of the downloaded speed trap data have been processed.

Figures 6, 7:
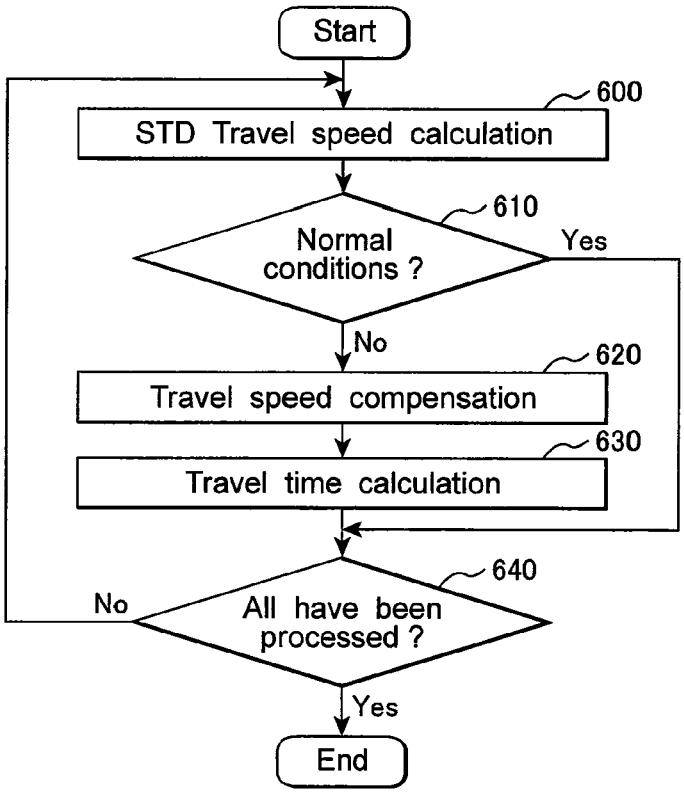
FIG. 6 shows aspects of an embodiment of the method according to the invention.
FIG. 7 shows an embodiment of a table that may be used to translate condition data into modification coefficients.

FIG. 6 illustrates another embodiment of the method for determining traffic data based on the statistical data and condition data, wherein in the example shown in FIG. 6 weather data is used as condition data. The weather data for example downloaded from the telematics center 111 may consist of area codes for which weather information is provided and the corresponding weather conditions (sunny/cloudy/rainy/snowy/foggy), the road surface (dry/wet/frozen), and the visibility (good/medium/bad in accordance with the distance of vision). Furthermore, the weather data may comprise a validity period specified by a beginning date and time as well as an ending date and time, for example. When the validity period is expired, the expired weather data may be removed from the update database 252.

Firstly, in step 600 based on all the link-IDs in the areas for which weather information is available, the statistical travel time on each link is extracted from the statistical data provided by the statistical data database 230.

In step 600, from the link travel times of the statistical data and the length of the link, the link travel speed of the statistical data is calculated. Afterwards, in step 610, the system decides whether the driving conditions on the link are normal.

Normal conditions may be assumed, for example, when the weather conditions are sunny or cloudy, the road surface is dry, and the visibility is over a predefined distance of vision. If the driving conditions are normal, the process goes to step 640.

Otherwise, the link travel speed of the statistical data is compensated in accordance with the driving conditions for example by the following formula:

$$V_m = \delta \cdot V_s,$$

wherein $V_s$ denotes the travel speed based on the statistical data and $\delta$ denotes a modification coefficient. The modification coefficient $\delta$ may be defined by a combination of the driving conditions like for example shown in FIG. 7. As shown by the first combination in FIG. 7, when the weather is sunny or cloudy, the road surface is dry, and the visibility is good the modification coefficient is 1.0, which means that no modification is carried out. Like illustrated by combination No. 2, when the weather is rainy, the road surface is wet, and the visibility is good a modification coefficient of 0.9 results.

In areas, in which a lot of traffic lights are installed, such as in city centers, the compensation of the travel speed may not be executed, unless the road surface is frozen or the visibility is bad, because on roads where many traffic lights are installed, the impact of the weather conditions may be reduced. An area with a lot of traffic lights may be determined, for example, by a comparison of the density of traffic lights or the road density with a threshold. Also on links that have a standard deviation of the travel times that is smaller than a predefined threshold, a compensation of the travel speed may not be executed.

In step 630, the travel time on the link is calculated based on the compensated travel speed $V_m$ and the link length.

In step 640, it is checked whether all the links for which weather data is available have been processed. If not all of them have been processed, the system goes back to step 600 and the procedure is iterated until all the links of the downloaded weather data have been processed.

Figure 8:
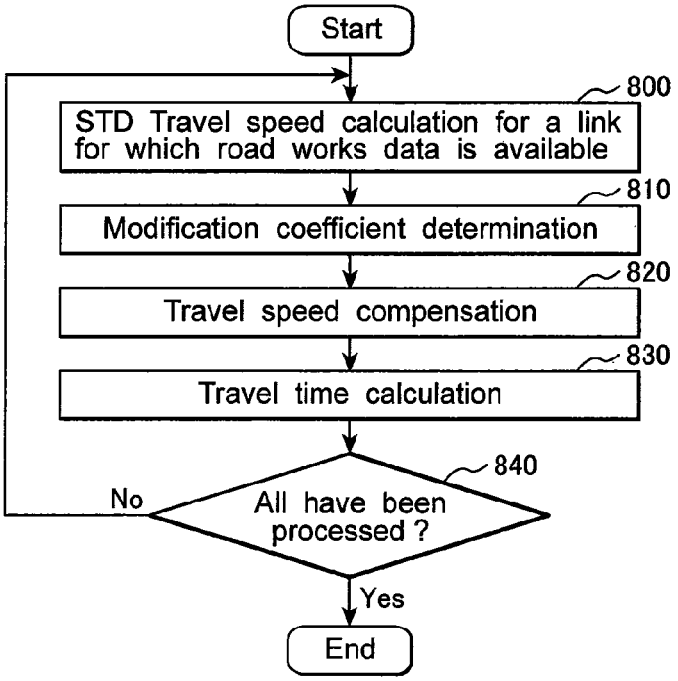
FIG. 8 shows aspects of an embodiment of the method according to the invention.

FIG. 8 illustrates another embodiment of the method for determining traffic data based on the statistical data and the condition data, wherein road works data is used as condition data.

Figure 9:
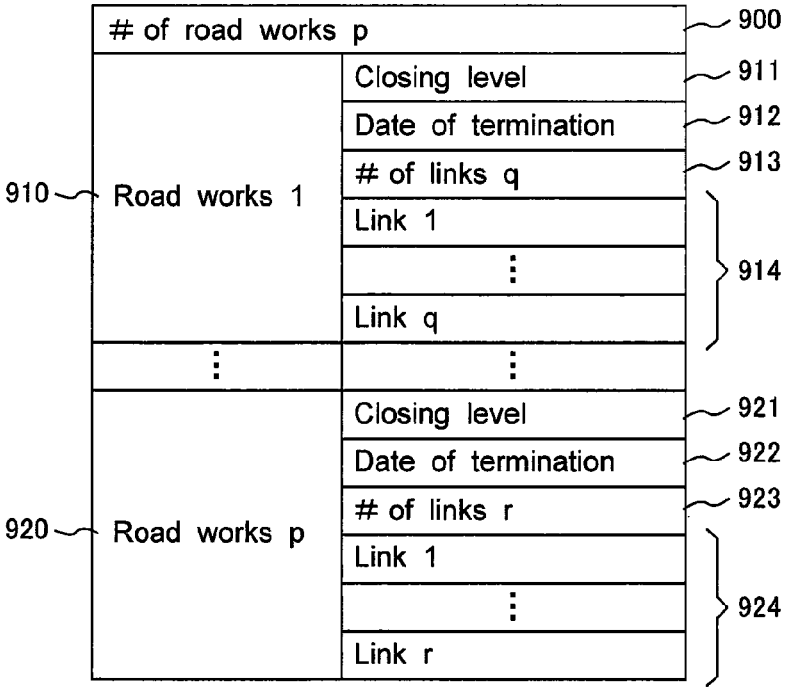
FIG. 9 shows an embodiment of condition data.

In step 800, the travel speed for a link for which road works data is available is calculated based on the statistical data. FIG. 9 shows an embodiment of road works data. In the field 900, it can be found how many road works entries will follow after this field. The first entry is road works 1 (field 910). It comprises a field 911 that specifies the closing level of the road that is caused by the road works and a field 912 that specifies when the road works will be terminated. Furthermore, in a field 913 it is specified how many links are affected by the road works, wherein the link-IDs of the affected links are specified in the fields 914. When the road works is terminated, the corresponding road works entry may be removed from the update database 252.

The other road works entries have the same structure as the structure of road works 1. In field 920, the entry for the last road works p is shown that comprises a closing level field 921, a field that specifies the date of the termination of the road works 922, a field for the number of links (field 923) and the link-IDs of the affected links (field 924).

In step 810 shown in FIG. 8, the closing level of the chosen link for which road works data is available is determined. Based on the closing level the travel speed is compensated in step 820.

Figures 10, 11:
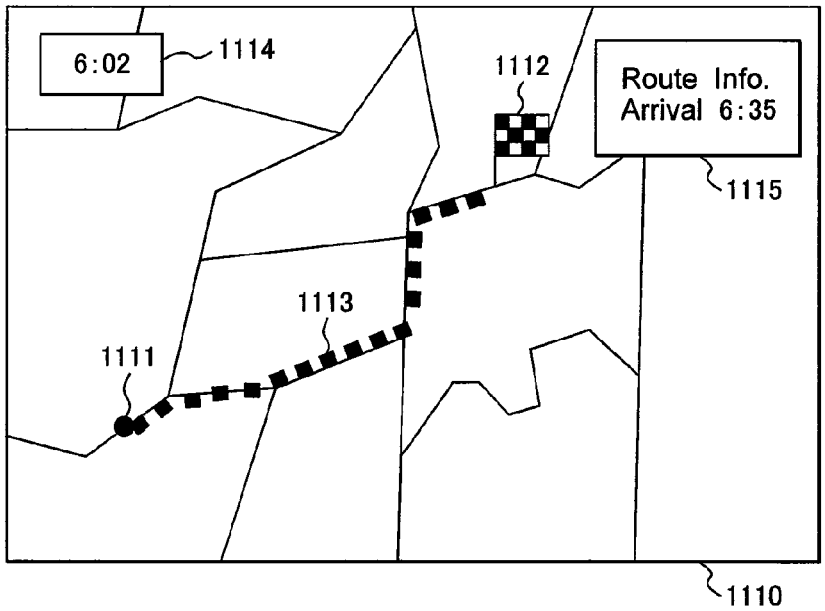
FIG. 10 shows an embodiment of a table that may be used to translate condition data into modification coefficients.
FIG. 11 shows an embodiment of a display used to display a recommended travel route to the user.

FIG. 10 illustrates an example how a modification coefficient may be determined based on the closing level. The closing level is denoted in column 1010. It is defined in accordance with a ratio $R_c$ of the number of closed lanes of the respective link and the total number of lanes that the respective link would have without the road works. In column 1000 shown in FIG. 10, various ratios $R_c$ are shown. Column 1020 illustrates the resulting modification coefficient $\epsilon$.

As shown in row 1030, when no lane is closed, the closing level is zero and a modification coefficient of 1.0 results. In the case that the ratio $R_c$ lies between zero and 0.34, the closing level is low and there is only a small impact on the traffic flow (row 1040). This situation is denoted by a closing level of 1 and a modification coefficient of 0.75. As shown in row 1050, a ratio $R_c$ between 0.34 and 0.67 means a medium closing level such that only a medium impact is to be expected on the traffic flow, which is referred to by a closing level of 2 and which leads to a modification coefficient $\epsilon$ of 0.5. When the ratio $R_c$ lies between 0.67 and 1.0 a high closing level is present, such that a big impact results which is denoted by a modification coefficient of 0.25. As shown in row 1070, a closing level of 4 means that the road is completely closed, such that a modification coefficient E of zero results.

In step 800, the travel speed for a link for which road works data is available is calculated based on the statistical data and the link-ID of the chosen link. The link travel speed of the statistical data is calculated based on the link travel time and the length of the link specified in the statistical data.

In step 810, the modification coefficient E is determined based on the closing level specified in the road works data and the table shown in FIG. 10.

In step 820, the link travel speed of the statistical data is compensated by the following formula:

$$V_m = \epsilon \cdot V_s,$$

wherein $V_m$ denotes the modified travel speed, $\epsilon$ denotes the modification coefficient and $V_s$ denotes the travel speed based on the statistical data.

In step 830, a travel time on the link is calculated based on the compensated travel speed $V_m$ and the length of the link.

In step 840, it is checked whether all the links for which road works data is available have been processed. If not all of them have been processed yet, the system goes back to step 800 until all the links for which road works data is available have been processed.

After the modification up-to-date traffic data is available at any time in the apparatus for travel time prediction according to the present invention. The updated traffic data may be stored for example in the update database 252. Based on the updated traffic data routes may be calculated, travel times may be predicted and estimated times of arrival may be determined. Due to the method for traffic data compensation the quality of the calculations is improved.

FIG. 11 illustrates one embodiment of an output of a navigation system that uses the present invention. A route 1113 is calculated from a travel start point 1111 to a travel end point 1112 and is displayed on a display 1110. In a field 1114 the current time is shown and in a field 1115 the estimated time of arrival is displayed.

Figure 12:
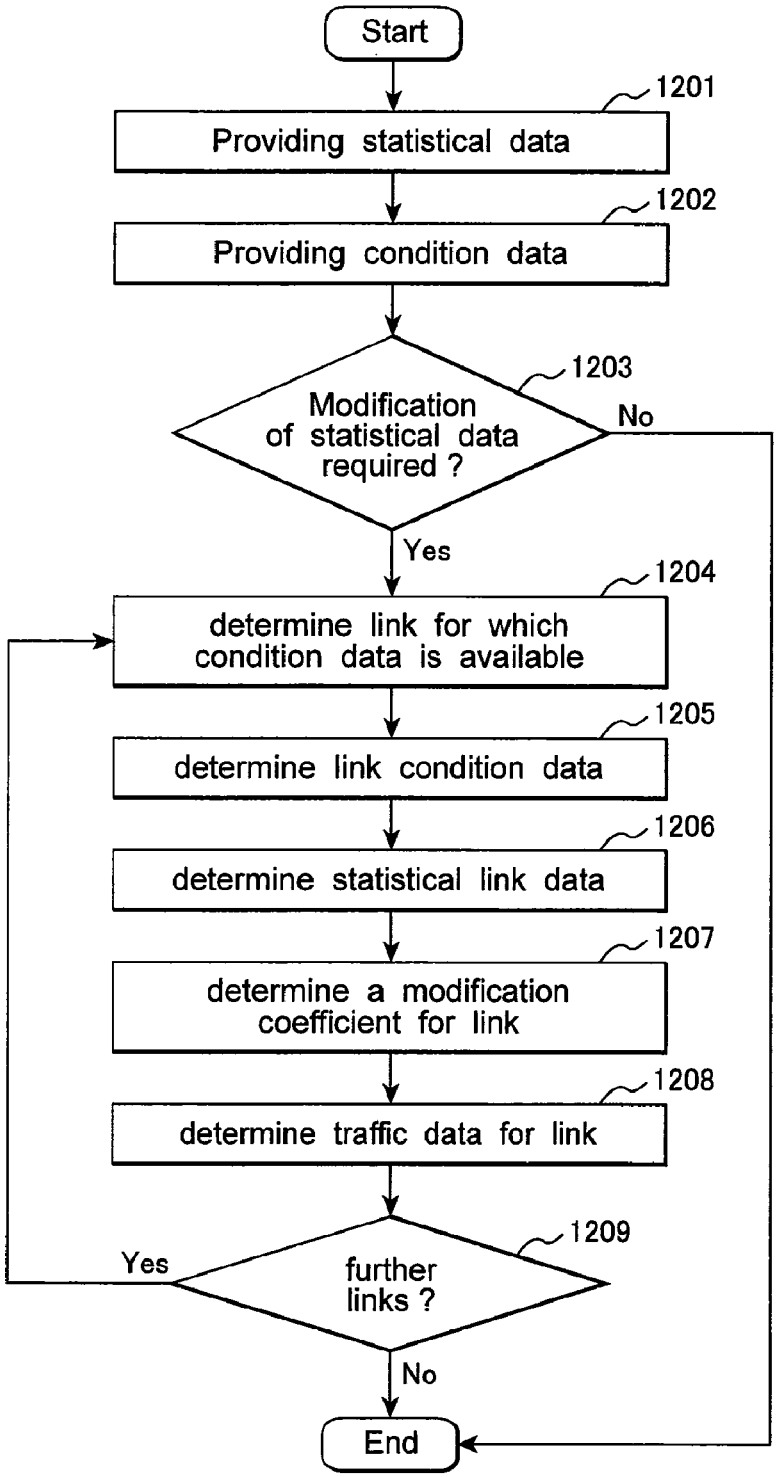
FIG. 12 shows one embodiment of the method for determining traffic data according to the invention.

FIG. 12 shows one embodiment of the method for determining traffic data according to the present invention. In step 1201, statistical data relating to traffic at links of a street map and, in step 1202, condition data relating to links of the street map are provided. In step 1203, it is verified whether or not a modification of the statistical data is required. If no modification is required, the method ends.

If a modification of the statistical data is required, in step 1204, a link for which condition data is available is determined. In step 1205, link condition data based on the link and the condition data is determined. Statistical link data based on the statistical data and said link is determined in step 1206. A modification coefficient for modifying the statistical link data based on the link condition data is determined in step 1207. Based on the statistical link data and the modification coefficient traffic data for the link is determined in step 1208.

In step 1209, it is verified whether or not all the links of the condition data have been processed. If this is the case, the method ends. If further links are present in the condition data that have not yet been processed, the method jumps back to step 1204.

Figure 13:
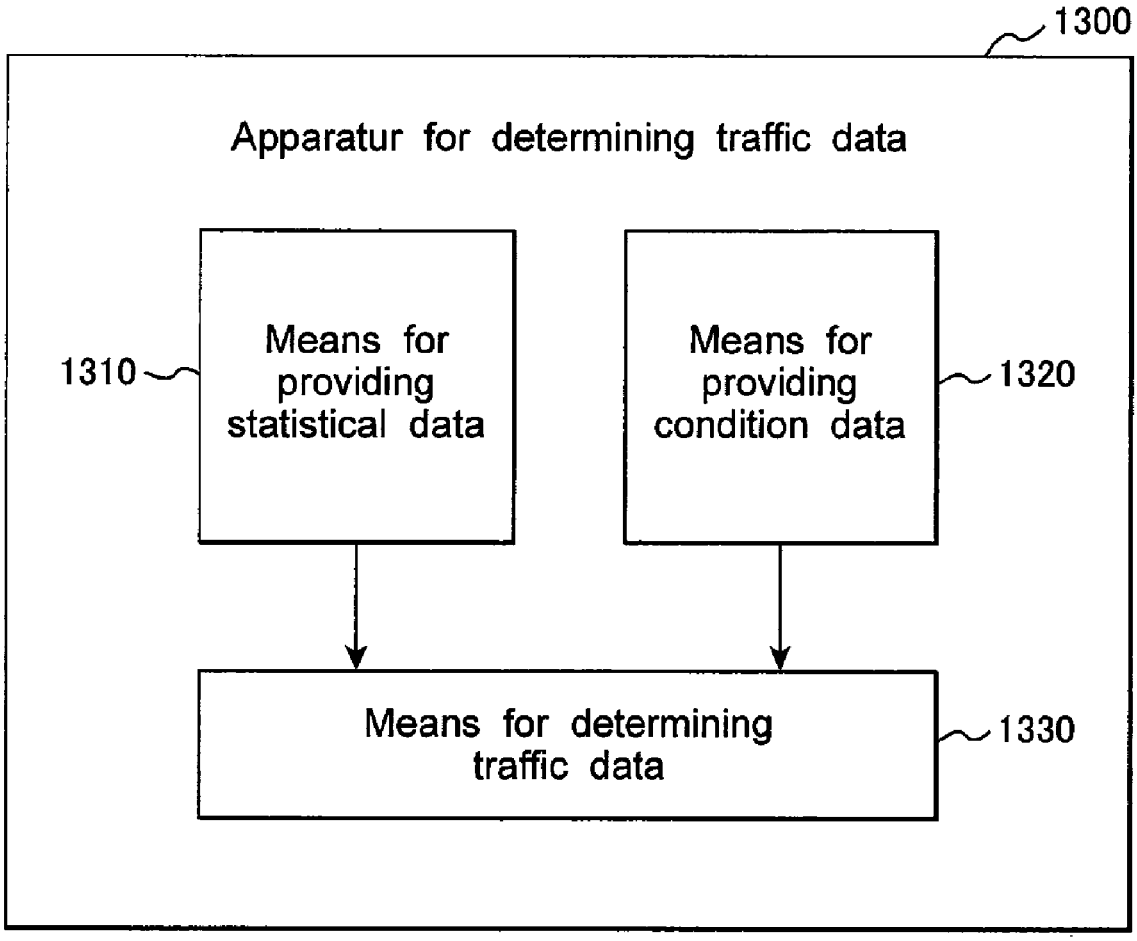
FIG. 13 shows one embodiment of the apparatus for determining traffic data according to the invention.

FIG. 13 shows one embodiment of the apparatus for determining traffic data according to the present invention. The apparatus for determining traffic data 1300 comprises means for providing statistical data relating to traffic at links of a street map 1310, means for providing condition data relating to links of the street map 1320, and means for determining traffic data based on the statistical data and the condition data 1330.

The specifications and drawings are to be understood in an illustrative rather than a restrictive sense. Various modifications may be made to the described embodiments without departing from the scope of the invention as set forth in the appended claims. The features of the described embodiments may be combined to provide further embodiments that are optimized for a certain usage scenario. As far as these modifications are readily apparent for a person skilled in the art, they shall be disclosed by the above described embodiments.

For example, of course the method according to the invention may determine traffic data based on condition data comprising speed trap data, weather data and road works data. The same applies to the corresponding apparatus.

The invention claimed is:

1. Method for determining traffic data, comprising the steps of:

receiving, by a processor, statistical data relating to traffic at links of a street map, wherein the statistical data comprise travel speed data that are statistically obtained for each link;

receiving, by the processor, condition data relating to the links of the street map, wherein the condition data comprise speed trap data and for at least one of the links:

determining, by the processor, for which portions of the link the speed trap data are available;

for each portion of the link, determining, by the processor, a first modification coefficient for modifying the travel speed data if the speed trap data are available, and determining, by the processor, a second modification coefficient for modifying the travel speed data if the speed trap data are not available; and determining, by the processor, the traffic data based on the travel speed data, the first modification coefficient for portions where the speed trap data are available, and the second modification coefficient for portions where the speed trap data are not available.

2. Method according to claim 1, further comprising the step of retrieving the condition data from a server.

3. Method for travel time prediction, comprising the steps of the method for determining traffic data according to claim 1, as well as the steps of receiving a travel start point and a travel end point, and predicting a travel time for traveling from the travel start point to the travel end point based on the determined traffic data.

4. Method according to claim 3, further comprising the step of calculating an estimated time of arrival based on a current time and the predicted travel time.

5. Method for travel route recommendation, comprising the steps of the method for travel time prediction according to claim 3, as well as the steps of predicting travel times for a plurality of routes for traveling from the travel start point to the travel end point based on the determined traffic data, determining the route of the plurality of routes having the shortest predicted travel time, and recommending the route with the shortest predicted travel time to a user.

6. Apparatus for determining traffic data, comprising a processor that is configured to:

receive statistical data relating to traffic at links of a street map, wherein the statistical data comprise travel speed data that are statistically obtained for each link;

receive condition data relating to the links of the street map, wherein the condition data comprise speed trap data and for at least one of the links:

determine for which portions of the link the speed trap data are available;

for each portion of the link, determine a first modification coefficient for modifying the travel speed data if the speed trap data are available, and determine a second modification coefficient for modifying the travel speed data if the speed trap data are not available; and determine the traffic data based on the travel speed data, the first modification coefficient for portions where the speed trap data are available, and the second modification coefficient for portions where the speed trap data are not available.

7. Apparatus for travel time prediction, comprising the apparatus for determining the traffic data according to claim 6, wherein the processor is further configured to:

receive a travel start point and a travel end point on the street map, and predict a travel time for traveling from the travel start point to the travel end point based on the determined traffic data and calculate an estimated time of arrival based on a current time and the predicted travel time.

8. Apparatus for travel route recommendation, comprising the apparatus for travel time prediction according to claim 7, wherein the processor is further configured to:

predict travel times for a plurality of routes for traveling from the travel start point to the travel end point based on the determined traffic data, determine the route of the plurality of routes having the shortest predicted travel time, and recommend the route with the shortest predicted travel time to a user.

* * * * *